US005366904A

United States Patent [19]

Qureshi et al.

[11] Patent Number: 5,366,904

[45] Date of Patent: Nov. 22, 1994

[54] METHOD OF METERING A FLUID USING A MULTI-MODE DIFFERENTIAL FLUID DISPLACEMENT PUMP

[75] Inventors: Humayun Qureshi, Wayland; Stanley M. Liffmann, Andover; John D. Czaban, Beverly, all of Mass.

[73] Assignee: DRD Diluter Corporation, Danvers, Mass.

[21] Appl. No.: 871,491

[22] Filed: Apr. 21, 1992

Related U.S. Application Data

[63] Continuation of Ser. No. 514,758, Apr. 26, 1990, abandoned, which is a continuation of Ser. No. 213,169, Jun. 29, 1988, Pat. No. 4,941,808.

[51] Int. Cl.[5] ..... G01N 1/00; G01N 33/48

[52] U.S. Cl. ..... 436/180; 222/309; 222/372; 417/488; 417/487; 73/864.35

[58] Field of Search ..... 417/415, 488, 498; 92/60, 60.5, 129; 222/309, 383, 372; 422/63, 64, 68.1, 100; 436/180; 73/864.35

[56] References Cited

U.S. PATENT DOCUMENTS

| | | | |
|---|---|---|---|
| 1,983,229 | 12/1934 | Hillier . | |
| 2,383,324 | 8/1945 | LeClair | 92/60 |
| 2,396,602 | 3/1946 | Posch | 92/60 |
| 3,168,045 | 2/1965 | Sebastiani | 92/60 |
| 3,333,548 | 8/1967 | Lyshkow | 92/60 |
| 3,471,079 | 10/1969 | Myers | 230/53 |
| 3,695,788 | 10/1972 | Loomans | 417/488 |
| 3,704,080 | 11/1972 | Cross | 417/486 |
| 3,802,805 | 4/1974 | Roeser | 417/398 |
| 3,913,787 | 10/1975 | Dilger | 222/26 |
| 4,089,624 | 5/1978 | Nichols et al. | 417/362 |
| 4,090,818 | 5/1978 | Hope et al. | 92/129 |
| 4,242,058 | 12/1980 | Zakora | 414/437 |
| 4,255,096 | 3/1981 | Coker, Jr. et al. | 417/415 |
| 4,279,991 | 7/1981 | Hagen et al. | 222/309 |
| 4,449,897 | 5/1984 | Garrett | 417/487 |
| 4,493,614 | 1/1985 | Chu et al. | 417/415 |
| 4,566,868 | 1/1986 | Menzies | 417/415 |
| 4,568,249 | 2/1986 | Todd | 417/238 |
| 4,610,544 | 9/1986 | Riley | 422/64 |
| 4,682,712 | 7/1987 | Bohnensieker | 222/137 |
| 4,715,791 | 12/1987 | Berlin et al. | 417/274 |
| 4,730,992 | 3/1988 | Ogawa | 417/465 |
| 4,815,978 | 3/1989 | Mazza | 422/63 |

FOREIGN PATENT DOCUMENTS

| | | | |
|---|---|---|---|
| 56635 | 3/1891 | Germany . | |
| 0546343 | 3/1932 | Germany | 417/488 |
| 0556538 | 10/1943 | United Kingdom | 92/60 |

*Primary Examiner*—David A. Redding
*Attorney, Agent, or Firm*—Wolf, Greenfield & Sacks

[57] ABSTRACT

A measured amount of a first fluid is metered into a measured amount of a second fluid by a method where a fluid is confined within a first chamber and a plunger of predetermined volume is mechanically moved into the chamber to displace a first measured amount of fluid after which a second plunger is mechanically moved into a defined volume of the chamber to displace a second volume of fluid therefrom different from the first volume whereupon the first and second volumes can be mixed in predetermined proportions.

8 Claims, 5 Drawing Sheets

METHOD OF METERING A FLUID USING A MULTI-MODE DIFFERENTIAL FLUID DISPLACEMENT PUMP

RELATED APPLICATIONS

This application is a continuation of application Ser. No. 07/514,758, filed Apr. 26, 1990 now abandoned, which is a continuation of application Ser. No. 07/213,169, filed Jun. 29, 1988, now U.S. Pat. No. 4,941,808, issued Jul. 17, 1990.

BACKGROUND OF THE INVENTION

It is often necessary in medical and process instrumentation to provide a small quantity of sample which is to be diluted with a larger quantity of reagent. Measuring an accurate dosage of the two different quantities provides some difficulty.

In some applications, two fluid displacement pumps or syringe pumps have been used to accurately meter small quantities of sample and larger quantities of reagent. In order to obtain very precise measurements, it is preferred not to use a syringe or displacement pump which to meter less than 10% of the volume of the syringe. So in applications where 10 microliters of samples has to be diluted with for example 500 microliters of reagent, two syringes or displacement pumps are needed such as a 100 microliter pump for sample and a 1000 microliter pump for reagent. This leads to duplication of parts and increased expense. Overall size can be larger than would be necessary with the single unit.

SUMMARY OF THE INVENTION

It is an object of this invention to provide a multi-mode, differential fluid displacement pump which provides high resolution for both small and large sample volumes in a single pump.

Still another object of this invention is to provide a mixing chamber having good mixing properties and being easily cleanable and which can be useful in connection with the pump of the preceding object.

Still another object of this invention is to provide a means and method for providing for precise measurements of first and second volumes of material in a single mixing area.

Still another object of this invention is to provide a displacement pump in accordance with the preceding objects wherein light-weight, relatively inexpensive constructions can be used with long lasting seals and low maintenance costs in a metering and measuring environment.

According to the invention, a multi-mode, differential displacement pump for obtaining at least two different measured doses with high resolution, has a first elongated chamber carrying first and second pistons therein. The first piston defines a first volume and is reciprocally mounted in the chamber. The second piston defines a second volume and is reciprocally mounted in the chamber. Means are provided for reciprocating the pistons as desired to obtain predetermined volume changes corresponding to movement of either or both of said first and second pistons whereby said volume changes can provide for said two different doses.

In the preferred embodiment, the pistons are axially elongated and are mounted for axial movement together or separately. Most preferably, one piston axially aligned with a second piston, is activated to move both pistons as one to provide a first measured dose whereupon movement of the one piston can stop while movement of the second piston continues to provide a second measured dose.

Supplementary valving and sampling probes can be attached to the pump to provide for a wide variety of usage in metering and mixing applications.

A single mixing chamber can be used with the pump to allow a vortex to mix the two doses. The use of the mixing chamber also allows cleaning of the outside of a sample carrying probe, before dilution of a sample carried in the probe, with diluent fluid in the mixing chamber.

This invention provides the ability to obtain high resolutions for both small and large sample volumes from a single pump. Preferably, the pump can be minimized in size. A single motor can be used with light-weight inexpensive construction and operation possible. Long lasting seals with lower maintenance can be employed. The pumps provide for variable resolution by change of components. Automatic priming and bubble removing are additional features of the invention.

BRIEF DESCRIPTION OF THE DRAWINGS

The above and other objects, features and advantages of the present invention will be better understood from the reading of the following specification in conjunction with the drawings in which.

BRIEF DESCRIPTION OF PREFERRED EMBODIMENTS

Figure 1:
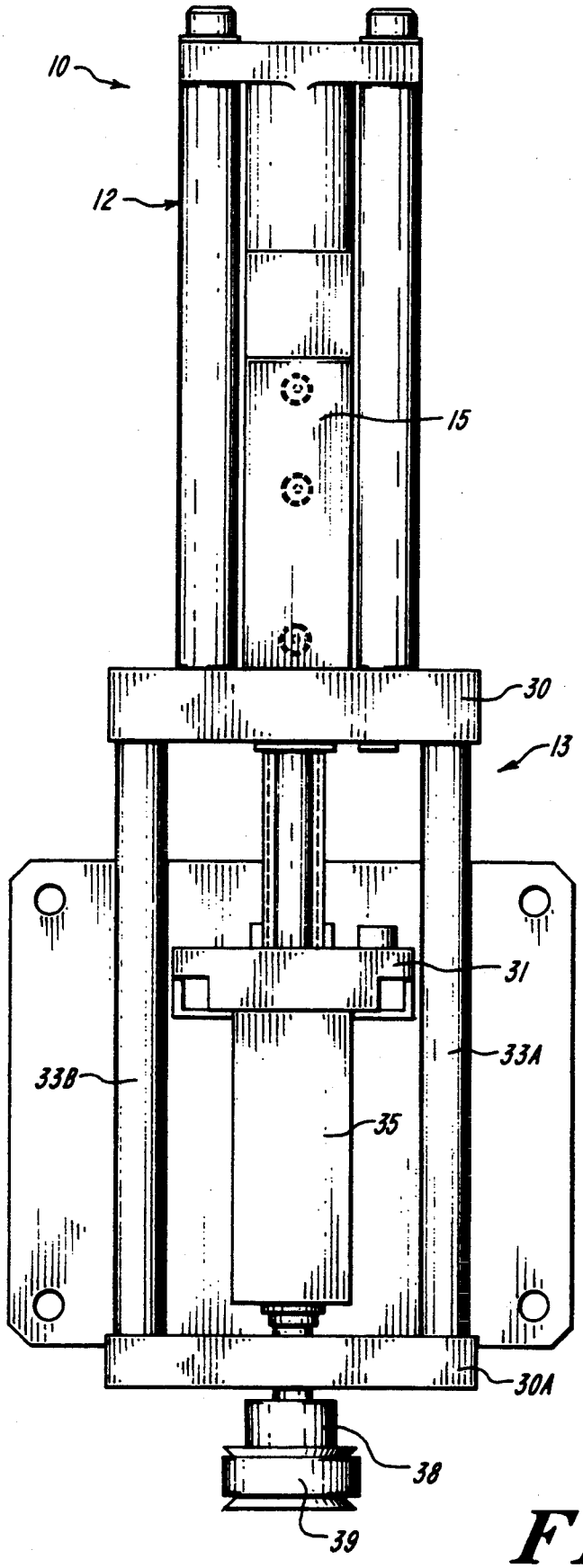
FIG. 1 is a front view of a preferred embodiment of the multi-mode differential displacement pump in accordance with this invention.
Figure 1A:
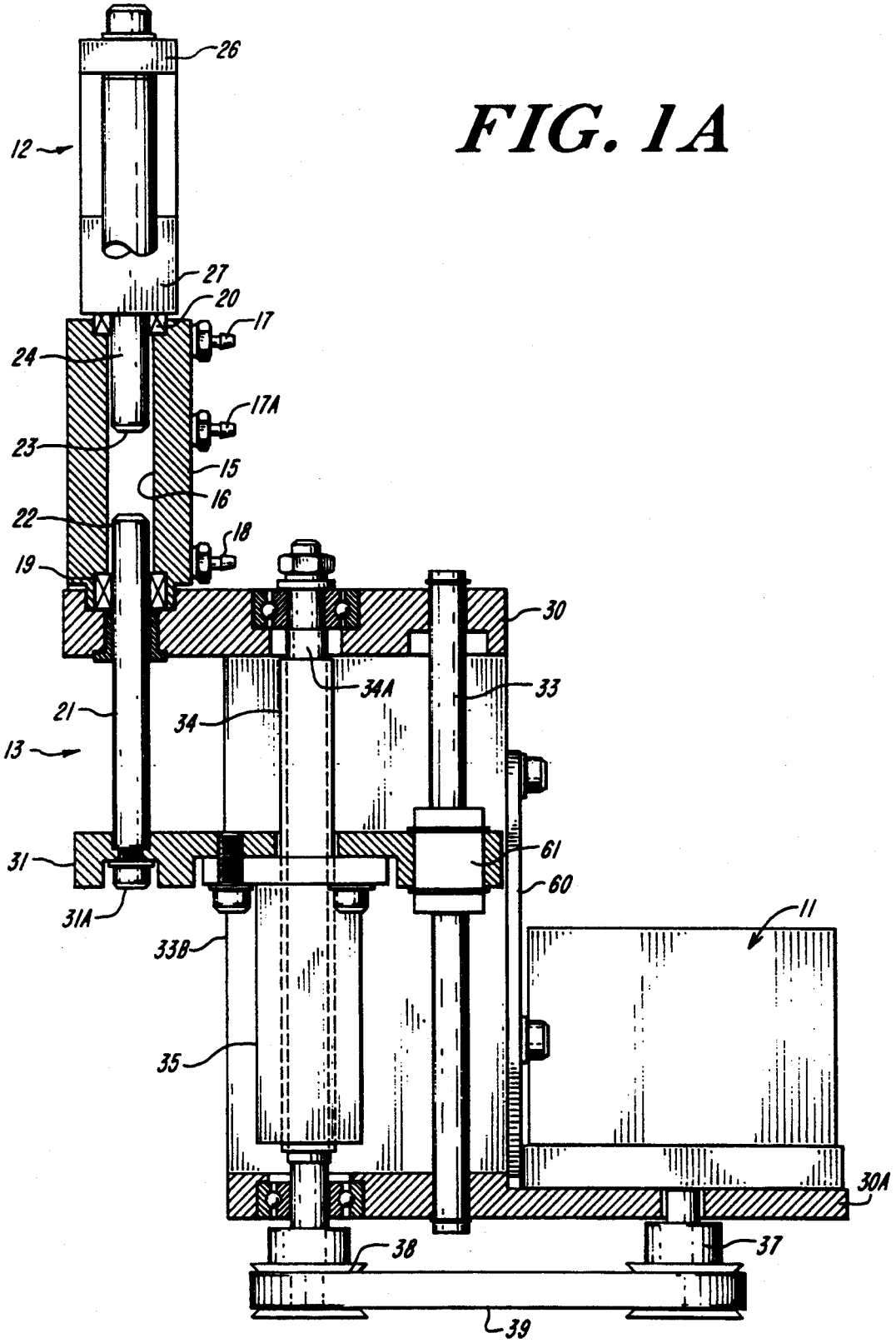
FIG. 1A is a side sectional view thereof taken through line A—A.
Figure 3:
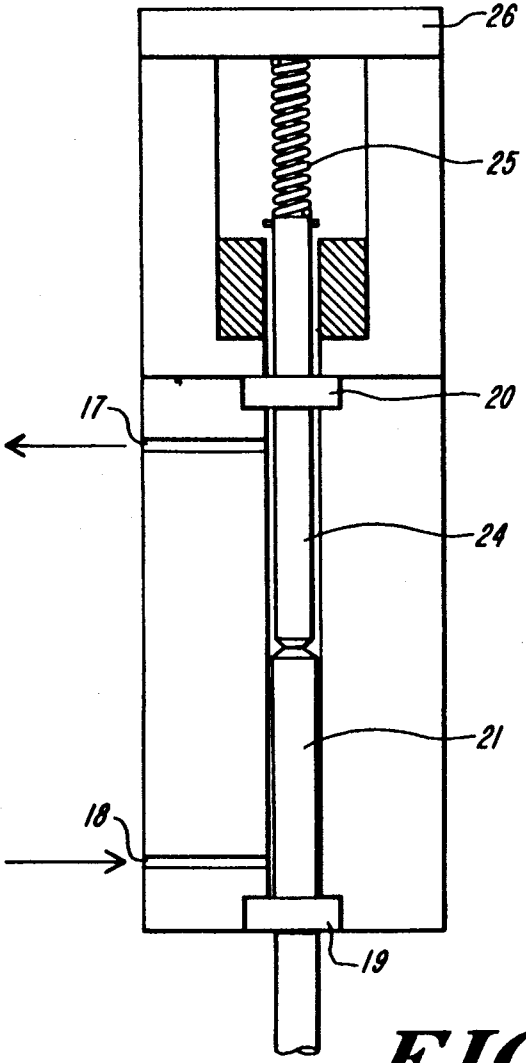
FIG. 3 is a semi-diagrammatic, cross-sectional view thereof at the end of a sampling cycle.

The multi-mode differential displacement pump of this invention is shown at 10 in FIG. 1 and comprises a pump measuring section 12 connected to a stepper motor 11 through a lead screw and adjusting or dosing section 13.

The pump measuring section 12 preferably comprises a block 15 defining a fluid-holding cylindrical chamber 16 having ports 17 and 18 for ingress and egress of fluids. A third port 17A can be provided for evacuation of air bubbles or other purposes if desired, although it is closed in the specific system described below. The chamber 16 is sealed by a stationary static seal 19 at one end and a second stationary static seal 20 at a second end spaced above the first end. A first solid piston or plunger 21 having a first diameter is reciprocally mounted within the chamber 16 and has an end 22 a butting end in contact with an end 23 of a second diameter solid piston or plunger 24 at the start of a reagent cycle. The first solid piston 21 and second diameter solid piston 24 each can be considered a solid body. The pistons 21 and 24 are sealed when immobile or sliding by the stationary seals 19 and 20 respectively which also seal the chamber 16 at the edge of the seals. Thus, seals 19 and 20 are double acting, reciprocating seals.

Piston 24 is spring tensioned to its lower most position by spring 25 acting against end plate 26. The piston 24 is mounted in a linear bearing 27 and has a stop pin 28 which limits downward travel constantly urged by the spring 25. Thus, piston 24 which is preferably coaxially aligned with piston 21 can reciprocate in an updown direction as shown in FIG. 2 and is constantly urged downwardly but can be moved upwardly by pressure acting upwardly through piston 21.

Figure 2:
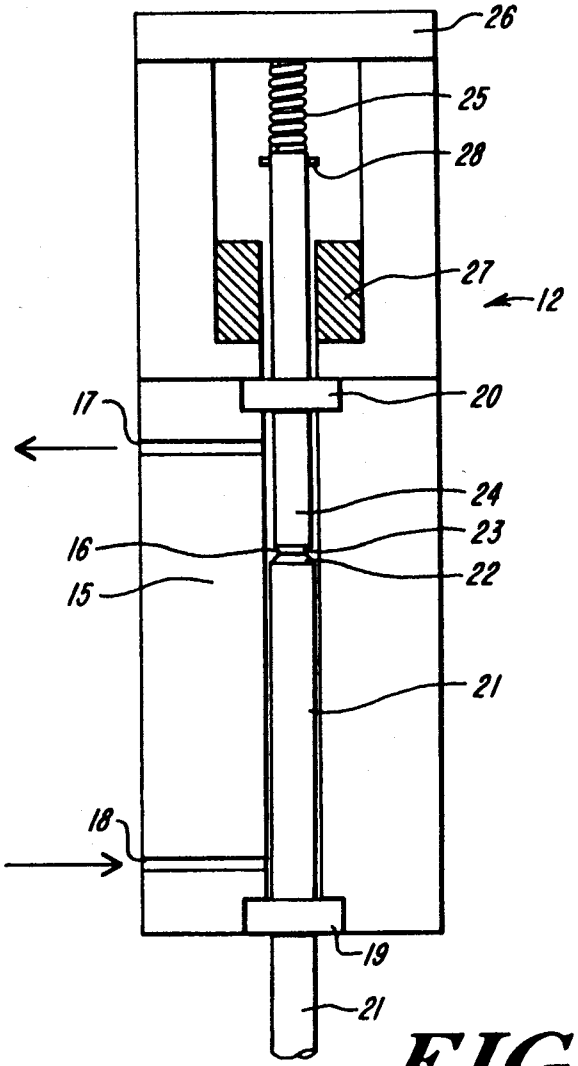
FIG. 2 is a semi-diagrammatic, cross-sectional view thereof at the start of a sampling cycle.
Figure 5:
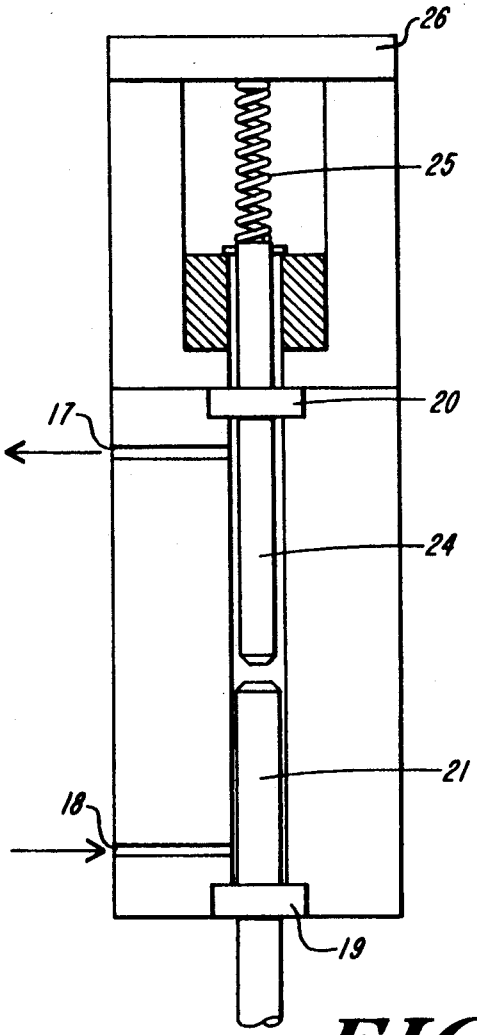
FIG. 5 is a semi-diagrammatic, cross-sectional view at the end of a diluent metering cycle.

As can be seen from FIG. 2, larger diameter piston 21 can move by itself or when it abutts end 23, and is moving upwardly or downwardly, it will move along with the small diameter piston 24. It should be noted that as the pistons move within the chamber 16, the volume within the chamber 16 changes in accordance with the volume of each piston moving into and out of the chamber or in the case where piston 24 is in its lower most position, chamber 16 changes by the volume of piston 21 as it moves alone.

The measuring section 12 is mounted on a frame formed by fixed plates 30, 30A, 33A and 33B which in turn mount a reciprocally moveable piston on a second plate 31 which reciprocates on guide rods 33 and screw shaft 34A. A screw arrangement 34 having shaft 34A is provided with an anti-backlash nut 35 to vary the distance between plates 30 and 31 as desired so as to vary and/or limit the movement of the pistons within the chamber and thus determine the volumemetric output from the chamber in one method of adjustment. Piston 21 is fixed on plate 31 by bolt arrangement 31A and moves therewith. A sliding bearing 61 for rod 33 and mounting means for frame members 60, and assembly 34A and 35 are provided. This structure is conventional and is available from KERK Motion Products, Inc., New Hampshire, as part No. KHD6050.

Screw shaft 34A is rotated, to move plate 31, through use of pulleys 37, 38 and drive belt 39 when the stepper motor 11 is activated. Any conventional linkage from the single electric motor 11 to the piston 21 can be used as desired.

The preferred embodiment of this invention, piston 24 has a length of 0.68 inch when fully extended in its lower most position into the chamber 16 and a diameter of 0.250 inch, chamber 16 has a diameter of 0.265 inch and a length of 2.150 inch. Piston 21 has a diameter of 0.2560 inch and a maximum length of travel within the chamber 16 of 1.6 inch. The volume of the chamber is 1500 microliters. The stepper motor is a 1.8°/step motor.

While specifics have been shown and described, it is obvious that all of the dimensions can vary greatly as can all the values given. The specific linkage and adjustment mechanism can vary. An important feature of the invention is the two diameter pistons within a chamber to provide different volumes upon activation preferably by a single drive means. In some cases the drive can be manual.

Preferably the pump is operated with a constantly full chamber 15 of a liquid so that displacement of the liquid by the moving pistons in a predetermined volume can cause picking up, or discharging of a predetermined volume of the same liquid as in the pump or of another liquid in another part a constantly filled system with which the pump is used. FIGS. 2–5 show different positions of the pistons in various steps in a fluid sampling cycle in one embodiment of the invention.

Figure 6:
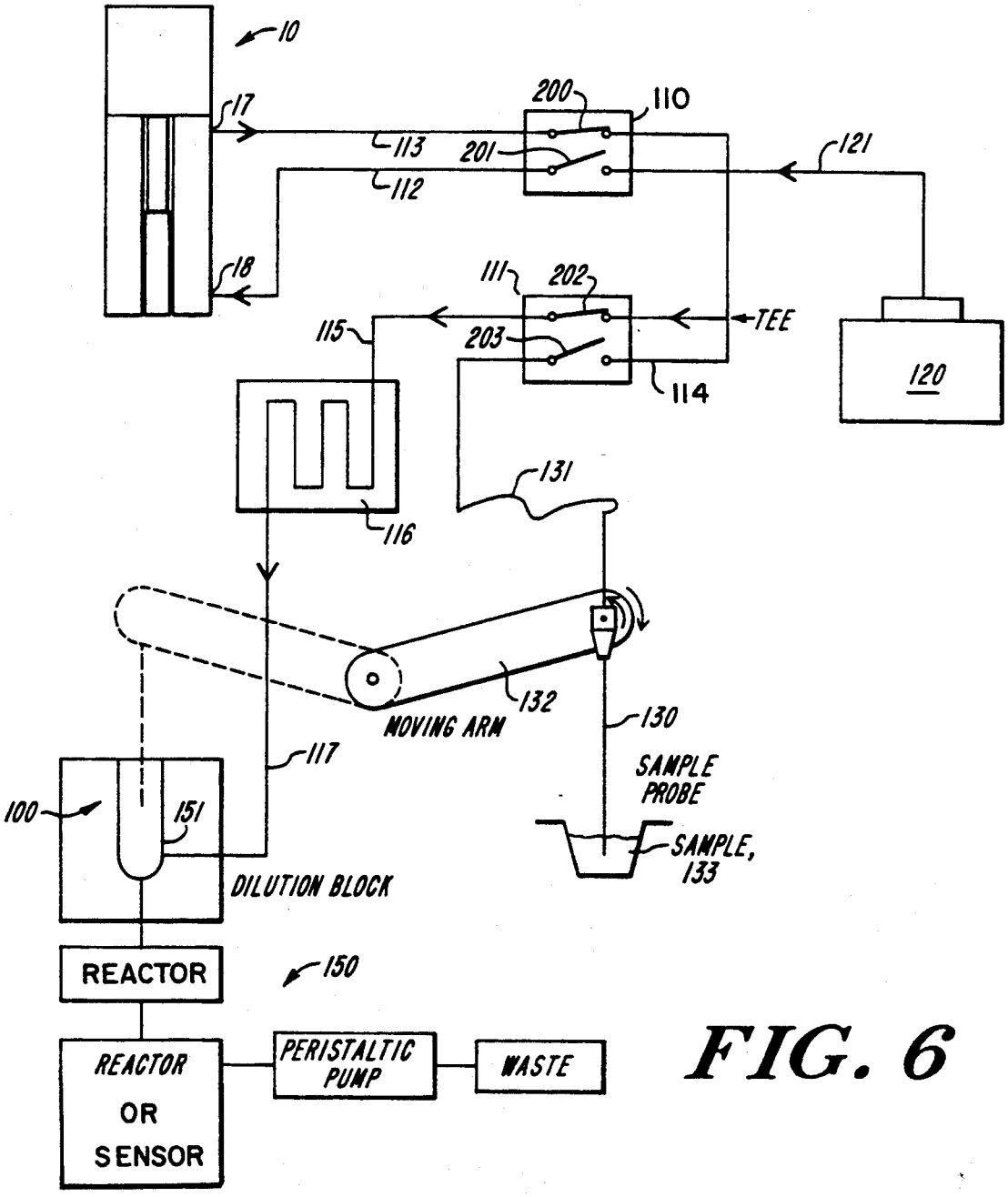
FIG. 6 is a semi-diagrammatic, diagram showing a system for using the multi-mode differential displacement pump of the present invention in connection with a mixing chamber for a sample to be mixed with a buffer in a laboratory measuring instrument.

Turning now to FIG. 6, the displacement pump 10 as shown is a system for mixing doses of fluid within a mixing chamber 100. The system is connected with an outlet from the dilution block to a first reactor and from it to a sensor or second reactor, a peristaltic pump and a waste area. A liquid sample and a liquid diluent such as a buffer can be mixed together in chamber 100. In the preferred embodiment, the buffer can be Tris buffer and the sample can be human serum or plasma for testing as in a glucose testing apparatus.

In the system shown in FIG. 6, two pinch valves 110, 111 are interconnected through tubes 112, 113 with ports 17 and 18, tubing 114, 115, preheater 116 and tubing 117 to the mixing chamber 100. The pump 10 is also connected through the valves 110, 111 as shown to a buffer bottle 120 through tubing 121 and to a sample probe 130 through tubing 131. The probe is mounted on a probe arm 132 capable of moving the probe from the dotted outline position to the full outline position as shown in FIG. 6. A sample 133 is provided in one position of the arm of the probe. The valves 110 and 111 act in conjunction with the pump to determine fluid flow within the system for measuring and mixing diluent (buffer) and sample (plasma) to form a dose. Doses of diluent and sample are delivered to the mixing chamber 100 from where the required mixed dosage can be provided to a testing apparatus indicated generally at 150.

In a first step of a typical operation of the system of FIG. 6 to dose, and mix a sample with a diluent such as a Tris buffer, the pistons are in the position shows in FIG. 2, and a tubular segment of air is picked up into the tubular sample probe 130. The air bubble formed is used so that when the sample is ultimately picked up by the probe it will not get diluted in the sample cup and it also prevents dispersion of the sample into other fluids. Three microliters of air can be picked up and this is accomplished by having the components of FIG. 6 in the solid line position without the sample cup, or in any intermediates position exposed to air. The probe tip can be immersed in a sample which can be blood, urine, plasma, serum or the like for example. With the pump pistons 21, 24 moving down, both pistons 21 and 24 are contacting and a very small downward movement of the pistons occurs as for example 0.075 inch to obtain 3 microliters of air in the probe. In this step, valve 110 is on and valve 111 is off, thus, port 200 is open to flow (open), port 201 is closed to flow (closed), port 202 is closed to flow and port 203 is open allowing an air slug to come from the probe tip through tubes 131, 114 and 113. Buffer fluid moves inwardly towards the pump port 17. After 3 microliters of air are picked up to separate the diluent from the sample, in a second step the probe is immersed in a sample cup as shown in FIG. 6 and both plungers continue downward movement causing a change in chamber 16 volume of 10 microliters to in turn cause 10 microliters of sample to be picked up in the sample probe. In the second step, valves 110, 111 remain in the same position as discussed with respect to step 1, with the elements of the pump in the position shown in FIG. 2. In a third step, the position of all components remains the same and another slug of air (4 microliters) is drawn into the probe with the sample cup withdrawn so that if the probe is wiped to clean it, a cloth wipe will not wick out the sample. This air gap also protects the sample when the outside of the probe is rinsed in the mixing chamber 100. All three of these steps are done with both plungers in contact and moving downwardly, valve 111 in the off position and 110 in the on position as described above. Steps 1, 2 and 3 are carried out with both pistons in contact and moving. The pistons are in the position shown in FIG. 3.

Figure 4:
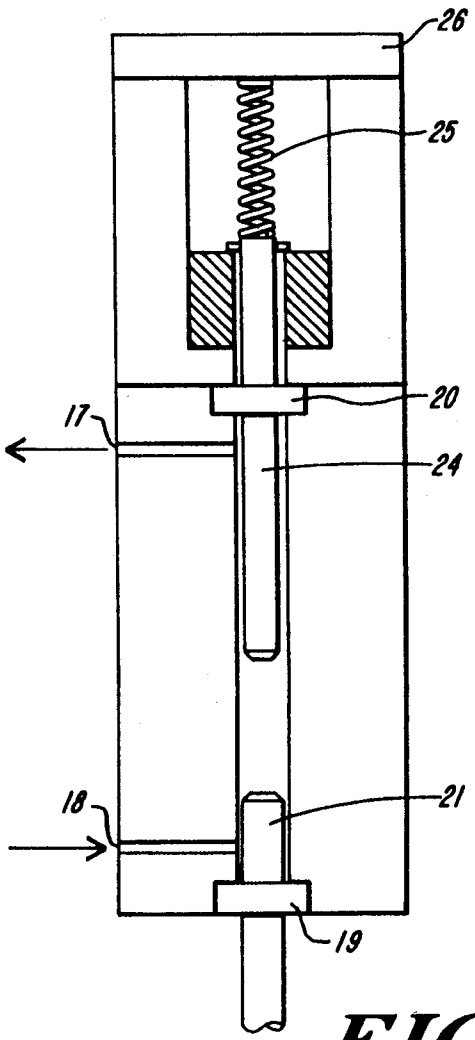
FIG. 4 is a semi-diagrammatic, cross-sectional view thereof at the start of a diluent metering cycle.

It step four, the pistons are in position shown in FIG. 4. Tris buffer is brought from the buffer bottle 120 into the pump in an amount of for example 650 microliters to fill the chamber 16 with diluent. The probe is moved to the dotted outline position of FIG. 6 and positioned in the mixing chamber where the outside of the probe is washed by buffer which has been left in the mixing chamber from the previous sample. A peristaltic pump (not shown) can be used to drain the fluid from the mixing chamber after this step. In this step, valves 110 and 111 are off, i.e., port 200 is closed, 201 is open allowing flow, 202 is closed and port 203 is open allowing flow.

The sample is now in the probe, the mixing chamber is empty and the pump is filled with buffer. At the end of step 4 the pistons are in the position shown in FIG. 4. In a fifth step, 150 microliters of buffer are put into the side port 151 of the mixing chamber by opening valve 110 as well as 111 with the probe tip below the fluid level and with only the larger diameter plunger moving. Port 200 is open, 201 closed, 202 open and 203 closed.

In a sixth step, valve 110 is open, valve 111 is closed with ports 200 open, port 201 closed, port 202 closed and port 203 open allowing flow of 10 microliters of sample followed by 40 microliters of buffer acting as a diluent to wash out the sample. This is accomplished by moving piston 21 upwardly.

In a seventh step, 450 microliters of buffer is put in the mixing chamber from port 151 at high velocity to cause vortex mixing and give a diluted sample. Valve 110 is open, valve 111 is also open with port 200 open, port 201 closed, port 202 open and port 203 closed to flow. The pistons are now in the positions shown in FIG. 5.

In an eighth step, the sample is moved into the reactor area by peristaltic pump action and the displacement pump 10 is loaded with buffer for cleaning the mixing chamber and probe. In this step, valves 110 and 111 are both off, i.e., port 200 is closed, port 201 is open allowing flow, port 202 is closed, port 203 is open allowing flow and flow occurs from the buffer bottle to the displacement pump port 18.

In a ninth step, analysis is carried out, data displayed and the mixing chamber can be emptied by the peristaltic pump.

In a tenth step, valve 110 is opened as is valve 111 thus port 200 is open allowing flow, port 201 is closed, port 202 is open allowing flow and port 203 is closed. Flow occurs through tubing 114, 115 to the mixing chamber to clean the chamber by pushing fluid from the pump to the chamber as for example 700 microliters of buffer is added to the mixing chamber 100.

In step eleven, the probe is back into the mixing chamber and 60 microliters are flushed through it to clean it. In this embodiment, valve 110 is opened and valve 111 is closed, i.e., ports 200 is closed allowing flow, port 201 is open, port 202 is closed and port 203 is open allowing flow. The sample probe is within the mixing chamber.

In step twelve, valve 110, 111 are off, i.e., port 200 is closed, port 201 is open allowing flow, port 202 is closed and port 203 is open allowing flow so that drain and discharge of the mixing chamber by the peristaltic pump can occur while 300 microliters of buffer can be reloaded from the buffer bottle through lines 121 and 112 into the pump as the pump volume is displaced by movement of the plunger 21. FIGS. 2–5 illustrate a positioning of the pistons during the various steps in the process.

In step thirteen, buffer is pushed into the mixing chamber, as for example 300 microliters, by moving the piston 21 upwardly with both valves 110 and 111 open, i.e., port 200 open to flow, port 201 closed, port 202 open and port 203 closed.

Figure 7B:
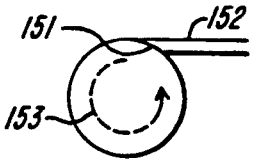
FIGS. 7 and 7A are a semi-diagrammatic showing of side and top views respectively of a preferred vortex mixing chamber and associated sampling probe useful in connection with this invention.
Figure 7A:
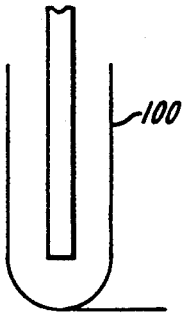

The mixing chamber 100 of the preferred system is a stationary chamber open to the atmosphere. It is cylindrical in shape with a round circular or sectional bottom. A bottom most position outlet circular passageway allows emptying of the chamber. An off center inlet tube 152 as shown in FIGS. 7 and 7A provides for mixing incoming liquid with liquid within the chamber by introducing a stream of incoming liquid off the center axis of the chamber to thereby cause a swirling vortex of liquid in the chamber (use dotted arrows 153). In the preferred embodiment the chamber has a diameter of 0.312 inch and the inlet has a diameter of 0.031 inch and enters the chamber side at an offset of 0.085 inch, i.e., it enters the chamber at the center point of a radius of the chamber at an angle of 90 degrees to the radius.

While specific embodiments of the invention have been shown and described, many variations are possible. Dosages of various materials can be made in different measured quantities, the specific amounts can vary greatly as will be obvious to those skilled in the art. By replacing the cylinders within the pump of this invention, and varying the diameters thereof, varying outputs from the pump can be achieved. The pump can be used in various environments for measuring different size amounts of fluids.

In some cases, the pistons need not be axially aligned, but are preferably positioned to be controlled by a single motor. In other cases, two or more separate different diameter (not shown) pistons are mounted in a defined volume chamber to reciprocate independently of one another to meter more than one dose from the chamber. So long as the pistons have different volumes they can displace different fluid volumes from the pump and they can be activated by independent motors for each piston.

Preferably, the pistons react to movement of one another at least during some portion of their travel.

In the preferred embodiment, using the displacement method in the preferred displacement pump, two plungers are used, however, three or more plungers can be used. The top plunger has a diameter of 0.2500 inch and is spring loaded with the bottom plunger having a diameter of 0.2560. The movement is accomplished up and down, by a lead screw and anti-backlash nut in accordance with a conventional linkage, although any linkage can be used as known in the art. The lead screw is preferably rotated by a 1.8°/step stepper motor. The total stroke of the lead screw can be approximately 1.6 inch. The bottom plunger when moved all the way up to its top most position, which is the home position for the pump, (a reference point for the stepper motor using an optomechanical flag to reference the top position of the plunger). This is a sampling position as shown in FIG. 2. At this position when the bottom plunger is moved down by a stepper motor through the lead screw, the top plunger will follow the bottom plunger because it is spring loaded and the spring force is much greater than the frictional force of the seal rubbing against the plunger. When the two plungers move as one, the displacement or aspiration of the fluid in the chamber will depend on the following conditions:

1. The diameter of the bottom plunger;
2. The diameter of the top plunger;
3. The distance moved down by the plunger;

In this case, the diameter (d1) of the bottom plunger is bigger than the diameter (d2) of the top plunger so when the two plungers move down as one, the fluid is aspirated into the chamber as a vacuum is created. The volume of fluid aspirated will be $((\pi(d1/2)^2-\pi(d2/2)^2)$ multiplied by the distance moved downward).

To pick up 10 microliters of fluid, the two plungers will have to move as one for 0.250 inch. This resolution is equivalent of that of a commercially available microliter syringe pump.

When it is time to pick up reagent, the bottom plunger can be moved down so that it is no longer in contact with the top plunger. The top plunger has a stop at the end of its stroke. When the two plungers are no longer in contact and the bottom plunger is moved down, the volume displaced in the chamber will be equivalent to $\pi(d1/2)^2$ multiplied by the distance moved down, which will be very large when compared to the volume displaced when the two plungers move as one. To aspirate 500 microliters of reagent, the plunger will have to move approximately 0.60 inch. This resolution will be equivalent to the resolution of a commercially available 2000 microliter syringe.

To displace the reagent and sample, the plunger will have to be moved up separately or together as one, as necessary. The particular pump of the preferred embodiment was designed to have a stroke of 0.62 inch for sampling and another stroke of one inch for reagent.

One can accurately aspirate a very small quantity of sample and dilute it with a much larger quantity of reagent by proper selection of piston diameters. The piston diameters are preferably constant or at least their cross section moving within the chamber is constant. The right combination of diameters and stroke length will provide any desired mixing proportion desired.

While the preferred embodiment is shown, variations can be made in the system as well as the specific components of the pump. The mounting mechanism for the two pistons can vary greatly as can the dimensions. Although the system preferably has two ports as shown, one or more valves can be used as can three-way valves and the like. The pump can be used at a number of applications in a number of different system arrangements of valves and tubing as will be obvious to one skilled in the art.

It can be seen from the above that the present pump can be used to meter different quantities of sample and reagent or buffer. The invention can replace the need for two separate syringes or displacement pumps. The unique two pumps in one, design can cut hardware cost and also avoids an excessive priming cycle unlike in conventional 100 microliter pumps where often the syringe has to be removed and manually primed to rid the system of air bubbles.

The displacement pump of this invention can be used for metering a sample in diluent or reactant as in biological analysis as when testing glucose, creatinine, cholesterol or other blood or body fluid concentrations. However, mixing a predetermined amounts of two fluids as when making up a dosage form for industrial uses where a small amount of one fluid is to be diluted in another fluid as for example amounts up to 1 milliliter to be diluted in amounts of 1 to 100 times or more of a diluent. Similarly, medicinal components can be admixed using the differential pump of the present invention. The various components can vary greatly. The pistons can be square, irregular shaped or round, solid or semi-solid materials can be used. The various seals and interconnection of the parts to move the pump may also vary as is known to those skilled in the mechanical arts. In some cases, rather than have a single piston move in conjunction with a second piston, and having one piston stop movement while the second piston continues its movement, the pistons can be arranged so that the second piston slides into the body of the first piston as the first piston moves towards the second piston. This is in fact a reversal of elements and would accomplish the function and should be considered within the scope of this invention.

What is claimed is:

1. A method of metering a measured amount of a first fluid into a measured amount of a second fluid comprising, confining a fluid within a first chamber of defined volume, mechanically moving a first displacement solid into said defined chamber volume to displace a first measured amount of said confined fluid therefrom, mechanically moving a second displacement solid into said defined chamber volume to displace a second volume of said confined fluid therefrom different from said first volume whereupon said first and second volumes can be mixed in predetermined proportion.

2. A method in accordance with the method of claim 1 wherein said first and second solids are in the form of first and second pistons having defined diameters with one piston diameter smaller than the second piston diameter and said chamber is filled with fluid in the form of a liquid.

3. A method in accordance with the method of claim 2 wherein said first piston is axially aligned with said second piston and reciprocally moveable therewith to a first position;

and said first piston is further mounted for movement to a second position without movement of said second piston.

4. A method in accordance with the method of claim 1 wherein said first and second solids are moved into said defined chamber volume by urging said first mentioned displacement solid against said second mentioned displacement solid and thereafter discontinuing movement of said first mentioned displacement solid while continuing movement of said second mentioned displacement solid.

5. A method in accordance with the method of claim 4 wherein said first and second displacement solids are in the form of first and second pistons which are axially aligned with each other, and one of said pistons is spring loaded into engagement with and end of the other of said pistons.

6. A method in accordance with the method of claim 5 wherein said chamber is filled with a liquid and first and second defined volumes removed from said chamber are used to define first and second corresponding doses of two selected materials which are intermixed with each other in a mixing area.

7. A method in accordance with the method of claim 6 wherein said first and second doses comprise a biological sample and a diluent respectively which are mixed in said mixing area and passed to a testing apparatus for analysis.

8. A method in accordance with the method of claim 7 wherein said biological sample is separated from said diluent by an airspace prior to passage to said mixing area.

* * * * *